US012336638B2

(12) United States Patent
Treffers

(10) Patent No.: US 12,336,638 B2
(45) Date of Patent: Jun. 24, 2025

(54) ADAPTABLE MATTRESS

(71) Applicant: MAXTRAS B.V., Wijchen (NL)

(72) Inventor: Willem Leonard Frits Treffers, Wijchen (NL)

(73) Assignee: MAXTRAS B.V., Wijchen (NL)

( * ) Notice: Subject to any disclaimer, the term of this patent is extended or adjusted under 35 U.S.C. 154(b) by 574 days.

(21) Appl. No.: 17/606,887

(22) PCT Filed: Mar. 27, 2020

(86) PCT No.: PCT/NL2020/050208

§ 371 (c)(1),
(2) Date: Oct. 27, 2021

(87) PCT Pub. No.: WO2020/197394

PCT Pub. Date: Oct. 1, 2020

(65) Prior Publication Data

US 2022/0211186 A1 Jul. 7, 2022

(30) Foreign Application Priority Data

Mar. 27, 2019 (NL) ..... 2022819

(51) Int. Cl.
*A47C 27/14* (2006.01)

(52) U.S. Cl.
CPC ..... *A47C 27/146* (2013.01); *A47C 27/148* (2013.01)

(58) Field of Classification Search
CPC ..... A47C 27/04; A47C 27/05; A47C 27/12; A47C 27/125; A47C 27/128; A47C 27/14; A47C 27/142; A47C 27/144; A47C 27/146; A47C 27/148; A47C 27/15; A47C 27/18; A47C 27/20; A47C 27/22
See application file for complete search history.

(56) References Cited

U.S. PATENT DOCUMENTS

| | | | | | |
|---|---|---|---|---|---|
| 2,198,724 | A * | 4/1940 | Schreiner | A47C 27/053 | 428/609 |
| 4,706,313 | A * | 11/1987 | Murphy | A47C 27/148 | 5/737 |
| 5,231,717 | A * | 8/1993 | Scott | A47C 31/123 | 5/400 |
| 6,317,912 | B1 * | 11/2001 | Graebe | A47C 23/047 | 5/655.8 |

(Continued)

FOREIGN PATENT DOCUMENTS

| | | |
|---|---|---|
| BR | 9605501 A | 8/1998 |
| DE | 29621191 U1 | 1/1997 |
| DE | 20108523 U1 | 9/2002 |

OTHER PUBLICATIONS

PCT International Search Report and Written Opinion, PCT International Application No. PCT/NL2020/050208, mailed May 13, 2020, 10 pages.

*Primary Examiner* — George Sun
(74) *Attorney, Agent, or Firm* — AEON Law, PLLC; Adam L. K. Philipp; Charlotte E. Holoubek

(57) ABSTRACT

The present invention is in the field of an adaptable mattress wherein parts are removably attached to one and another. The mattress, or at least one part thereof, is typically reusable, and hence also recyclable. The mattress can be adapted to a user thereof. The present invention also relates to a method of forming said adaptable mattress, and to a kit of parts.

2 Claims, 3 Drawing Sheets

(56) References Cited

U.S. PATENT DOCUMENTS

| | | | | |
|---|---|---|---|---|
| 8,117,700 | B2 * | 2/2012 | Howard | G06Q 30/0621 5/690 |
| 2007/0022540 | A1 * | 2/2007 | Hochschild | A47C 27/001 5/738 |
| 2012/0324651 | A1 * | 12/2012 | Essers | A47C 31/006 5/691 |
| 2013/0061395 | A1 * | 3/2013 | Karl | A47C 31/02 5/503.1 |
| 2014/0130265 | A1 * | 5/2014 | Lauer | A47C 27/148 5/727 |
| 2014/0189951 | A1 * | 7/2014 | DeFranks | A47C 21/044 5/423 |
| 2014/0201925 | A1 * | 7/2014 | Tursi, Jr. | A47C 27/14 5/722 |
| 2014/0325763 | A1 * | 11/2014 | Mason | B29C 44/06 264/154 |
| 2015/0089750 | A1 * | 4/2015 | Kertesz | A47C 27/001 156/244.18 |
| 2015/0289667 | A1 * | 10/2015 | Oakhill | A47C 27/18 5/423 |
| 2015/0296992 | A1 * | 10/2015 | Ghanei | A47C 27/15 5/423 |
| 2016/0128487 | A1 * | 5/2016 | Eskridge, III | A47C 27/14 5/423 |
| 2018/0125256 | A1 * | 5/2018 | Tsern | A61B 5/7267 |
| 2018/0344046 | A1 * | 12/2018 | DeFranks | A47C 21/042 |

* cited by examiner

Fig. 8a
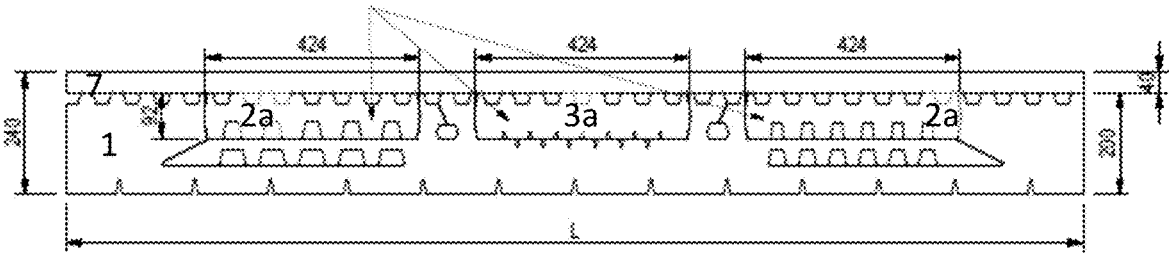
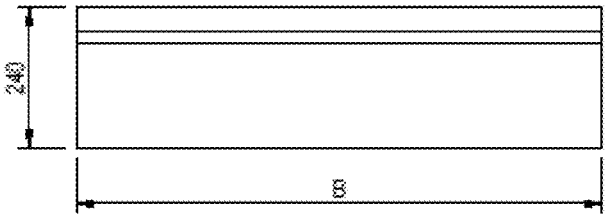
Fig. 8b
Fig. 8c
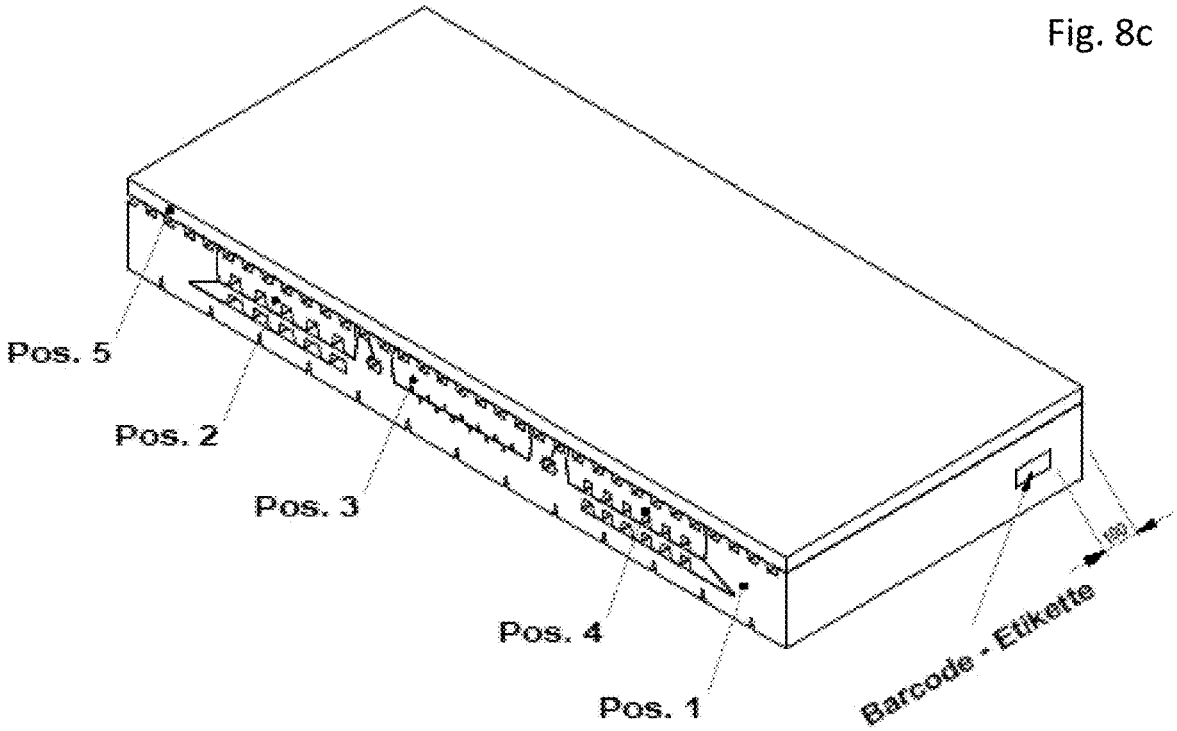

ADAPTABLE MATTRESS

CROSS-REFERENCE TO RELATED APPLICATIONS

This application is a U.S. National Phase entry of, and claims priority to, PCT International Phase Application No. PCT/NL2020/050208, filed Mar. 27, 2019, which claims priority to Dutch Patent Application No. NL 2022819, filed on Mar. 27, 2019. The entire contents of the above-referenced applications and of all priority documents referenced in the Application Data Sheet filed herewith are hereby incorporated by reference for all purposes.

FIELD OF THE INVENTION

The present invention is in the field of an adaptable mattress wherein parts are removably attached to one and another. The mattress, or at least one part thereof, is typically reusable, and hence also recyclable. The mattress can be adapted to a user thereof. The present invention also relates to a method of forming said adaptable mattress, and to a kit of parts.

BACKGROUND OF THE INVENTION

The present invention is in the field of a mattress. A mattress is a large, rectangular pad for supporting a resting body. It is designed to be used as a bed or on a bed frame, as part of a bed. Mattresses may consist of a quilted or similarly fastened case, usually of heavy cloth, that contains materials such as hair, straw, cotton, foam rubber, or a framework of metal springs. Mattresses may also be filled with air or water. Mattresses are usually placed on top of a bed base. They may be supplied with a secondary mattress and a removable topper. The present invention specifically relates to a foam mattress and in particular to an all-foam mattress, as well as to a spring mattress.

All-foam mattresses use different weights and densities of foams, typically petrochemical-based, flexible polyurethane foams and viscoelastic foams or memory foam, and latex rubber foams. Clearly also biodegradable foams and biobased foams may be considered. A foam often applied is latex, which is generally a blend of natural and synthetic latex. Also so-called memory foam may be used, typically in combination. Memory foam typically softens and conforms to the sleeper in response to body temperature and body weight. Latex and memory foam mattresses each provide specific characteristics. Open-cell memory foams, pinhole cored memory foam, gel-infused memory foams, channel-cut foam cores, reticulated foam support layers and other technologies may be used to improve air circulation through all-foam beds. Further high-density foams may be used, which are more compact compared to polyurethane.

In view of costs mattresses are typically offered as a one-size-fits-all mattress. This concept clearly can not adapt for specifics of a user, such as body-weight, body structure, length, and so on.

Incidentally some documents recite matrasses. BR 9 605 501 A recites a cushion mat, a surface plate and a back plate which are superimposed on the upper and lower surfaces of a frame plate and plural rolls and a roll supporting plate as a core material are housed and arranged inside the recessed part of the frame plate. The respective rolls are formed by inserting a second roll material composed of a hard cushion material to the inner hole of a first roll material composed of a soft cushion material and are supported in a parallel state with a prescribed interval on the roll supporting plate. DE 201 08523 U1 recites a system mattress with variable elasticity, which has a trough-like base body with a base plate as well as side walls, at least one exchange module reversibly insertable into the base body for locally changing the elastic property of the mattress and at least one cover element resting on the base body. DE 296 21 191 U1 recites a mattress with a core consisting of foam and/or latex or the like, which has several, 5 zones of different hardness each extending at least approximately over the full mattress width. U.S. Pat. No. 4,706,313 A recites a mattress that consists of a foam body having recesses at positions corresponding to the locations of protruding portions of a patient lying on the mattress. Foam blocks can be selectively placed in portions of the recesses. An encasement member encases the foam body and includes a top foam sheet. A bloused waterproof, non-shearing, flame retardant and antibacterial top sheet forms a portion of the encasement member covering the foam sheet.

There is therefore a need for an improved and adaptable. It is an object of the present invention to provide such a mattress which overcomes one or more of the above disadvantages, and a method of forming an adhesive, without jeopardizing functionality and advantages.

SUMMARY OF THE INVENTION

The present invention relates to an adaptable mattress (10), comprising a main part (1), the main part typically being formed as one piece, the main part comprising at least 2 recesses (2,3,5,6), each recess extending substantially over a width of the main part, each recess being provided on a top or bottom side of the main part, wherein the main part for instance comprises a first polymeric foam, at least two cassettes (2*a*,3*a*,5*a*,6*a*) for filling the recesses, wherein each cassette individually comprises a second polymeric foam, wherein each cassette is less resilient than the main part, each cassette having a height, a width, and a length, wherein the length of each cassette is substantially equal to a width of the main part, and wherein a height of a cassette is typically substantially equal to a height of the respective recess, wherein the recesses are adapted to fix each respective cassette, a topper (7) applied on a top side of the main part, the topper comprising a third material, wherein the third material has a different resilience than that of both the main part and cassettes, and a cover (8), the cover surrounding the main part, the cassettes, and the topper, wherein the main part, the cassettes, the topper, and the cover are removably attached to one and another, i.e. no glue or adhesive is used. The present mattress can therefore be configured according to specific demands of a user. The mattress can be ordered, such as online ordered, and tailor made. All elements of the present mattress can be replaced and be exchanged. As such adaptions, such as in terms of comfort, can be made at home, in an initial stage or in a later stage. In view of wear typically only a limited number of elements, such as the cassettes, can and may be replaced. The remainder need not be replaced, which reduces spillage. A sustainable and environmentally friendly mattress is created. Fewer raw materials are used and need to be processed, as only small parts have to be replaced, which increases the lifetime of the large volume. For instance, the production of synthetic foam is considered extremely energy-efficient. A foam volume is obtained from a liquid form (which is compact in delivery) and converted into a solid and machinable foam form through a chemical reaction. As a result, the volume increases approximately 24-fold in the factory. Then automated processing and/or confection may take place. The present mattress when finished is then reduced in volume to about 20% of a comparable traditional mattress transport, by compressing and vacuuming. Also less waste is generated, as only small parts need to be replaced over a longer period in case of changing living conditions or wear. Also less volume needs to be transported, so in total fewer transport movements have to take place. All mattresses and parts can be 100% recycled and/or reused in another form, especially as no adhesive is used. Because the production of the product can be established in one continuous line, energy consumption is reduced. And as the parts are compressed and can be sent directly to the consumer, so that there also again some transport movements can be saved.

In the present adaptable mattress the first cassette (2*a*) located at a shoulder section of the mattress comprises more air circulation supporting elements (9) than the second cassette (3*a*) located at a hip section of the mattress.

In an exemplary embodiment of the present adaptable mattress a third cassette (6*a*) located at a shoulder section of the mattress comprises more air circulation supporting elements (9) than the second cassette (3*a*) and less air circulation supporting elements (9) than the fourth cassette (5) located at a hip section of the mattress.

In a second aspect the present invention relates to a method of forming an adaptable mattress according to the invention comprising establishing at least one of a length of a user, a weight of a user, a hip height of a user, a shoulder height of a user, and a gender, and selecting at least one of the main part (1) adapted to the user, a cassette (2*a*,3*a*,5*a*,6*a*) adapted to the user, a topper (7) adapted to the user, and a cover (8) adapted to the user.

In a third aspect the present invention relates to a kit of parts comprising at least two of the main part, the at least one cassette, the topper, and the cover, according to the invention.

Thereby the present invention provides a solution to one or more of the above-mentioned problems.

Advantages of the present description are detailed throughout the description. The teachings and examples of the present invention may be combined into a further not specifically disclosed exemplary embodiment.

DETAILED DESCRIPTION OF THE INVENTION

In a first aspect the invention relates to an adaptable mattress according to claim 1.

In an exemplary embodiment of the present adaptable mattress no adhesive may be present.

In an exemplary embodiment of the present adaptable mattress the main part comprises springs, such as pocket springs, such as springs with 1-3 mm thick wires, preferably 1.5-2.2 mm thick wires.

In an exemplary embodiment of the present adaptable mattress at least one cassette comprises springs, such as 2-all cassettes. So some or all cassettes may comprise springs, such as depending on a user's requirement.

In an exemplary embodiment of the present adaptable mattress the main part comprises a first polymeric foam, such as in the case of an all foam mattress.

The present foams may be selected, each independently, from polyether PUR foams, such as standard and fire-retardant polyether PUR foams, very breathable viscoelastic foams, and gel materials with cooling effects. These foams have outstanding resilience and climate-regulating properties. Very high resilience climate foams (such as EvoPor-eVHRC) provide sleeping comfort and excellent ergonomic support. These foams maintain excellent stability and consistent support over time.

The present foams may have densities (DIN EN ISO 845) of 10-40 kg/m3, preferably 20-35 kg/m3, a compression load under deflection (DIN EN ISO 3386-1) of 3-7 kPa, preferably 3.5-6 kPa, such as 4.0-5.5 kPa, a tensile strength (DIN EN ISO 1798) of >80 kPa, preferably >100 kPa, such as 120-220 kPa, an elongation at break (DIN EN ISO 1798) of >100%, preferably >120%, such as 150-230%, and combinations thereof. Examples thereof are B2240, SKT 2537, B2550, B3030, MT 3035, MTC 3039, B3045, B3360, B3525m B3530, B3540, LT 3541, LTH3541, LTH3547, LS 3564, B3840, B3850, TEX4040, B4060, TEX4350, TEX4848, and LR4872, and combinations thereof, available at FoamPartner, Switzerland.

In an exemplary embodiment of the present adaptable mattress each cassette individually comprises a second polymeric foam, which second polymeric foam is less resilient than said first polymeric foam.

In an exemplary embodiment of the present adaptable mattress each cassette individually may comprise a similar or a same resilient material, or a different resilient material.

In an exemplary embodiment the present adaptable mattress may comprise two or three recesses (2,3) at a top side of the main part (1), and two or three cassettes (2*a*,3*a*) at said top side, and two or three recesses (5,6) at a bottom side of the main part (1), and two or three cassettes (5*a*,6*b*) at said bottom side, wherein in case of three recesses the recesses are provided asymmetrically. In case of three cassettes the present mattress is adapted to at least two different users, such as having a different weight and/or a different length.

In an exemplary embodiment of the present adaptable mattress the first cassette (2*a*) located at a shoulder section of the mattress comprises a less resilient, material than that of the second cassette (3*a*) located at a hip section of the mattress. Resilience is the ability of a material to absorb energy when it is deformed elastically, and release that energy upon unloading. The material (throughout the description) may relate to a polymer foam, to a (pocket) spring section, or a combination thereof.

In an exemplary embodiment of the present adaptable mattress the third cassette (6*a*) located at a second shoulder section of the mattress comprises a more resilient material than that of the second cassette (3*a*) and more resilient than that of the fourth cassette (5) located at a second hip section of the mattress. As such the present mattress is suited for use by two different persons. In case of only three cassettes provided at one side, a similar situation occurs, the fourth cassette then being absent.

In an exemplary embodiment of the present adaptable mattress the third cassette (6*a*) located at a second shoulder section of the mattress comprises incorporated therein at least one active air circulation element, such as for providing oxygen, for providing an airborne fragrance, and for providing humidity.

In an exemplary embodiment the present adaptable mattress may comprise at least one air circulation supporting element (9).

In an exemplary embodiment of the present adaptable mattress air circulation elements may be selected from a protrusion, a cavity, an incision, a spring, and combinations thereof.

In an exemplary embodiment of the present adaptable mattress air circulation elements extend over a width of the mattress, extend over a part of the width, and combinations thereof.

In an exemplary embodiment of the present adaptable mattress 5-50 air circulation elements may be provided on a top side of the main part.

In an exemplary embodiment of the present adaptable mattress 5-50 air circulation elements may be provided on a bottom side of the main part.

In an exemplary embodiment of the present adaptable mattress 1-10 air circulation elements may be provided in a central section of the main part.

In an exemplary embodiment of the present adaptable mattress 1-10 air circulation elements may be each individually provided on a top side of the cassette.

In an exemplary embodiment of the present adaptable mattress 1-10 air circulation elements may be each individually provided on a bottom side of the cassette.

In an exemplary embodiment of the present adaptable mattress 1-10 air circulation elements may be each individually provided on a bottom side of the recess.

In an exemplary embodiment of the present adaptable mattress air circulation elements of the recess and cassette may be provided facing one and another.

In an exemplary embodiment of the present adaptable mattress air circulation elements of the recess and cassette may be provided alternating.

Air circulation elements may have a height of 1-100 mm, such as 2-50 mm, e.g. 10-25 mm, a width of 1-50 mm, such as 2-25 mm, e.g. 10-15 mm, and may extend over a width of the mattress, or part thereof, such as 2-50 mm, e.g. 10-25 mm.

In an exemplary embodiment of the present adaptable mattress the main part comprises an edge (1*a*) at each side of each recess for preventing movement of the cassette in the recess.

In an exemplary embodiment of the present adaptable mattress each recess individually has at least one oblique lower side (2*b*,3*b*,5*b*,6*b*), and wherein each cassette individually has at least one oblique lower corresponding side (2*c*,3*c*,5*c*,6*c*).

In an exemplary embodiment of the present adaptable mattress each recess individually has at least one oblique upper side (2*d*,3*d*,5*d*,6*d*) for fixing the cassette, and wherein each cassette individually has at least one oblique upper corresponding side (2*e*,3*e*,5*e*,6*e*).

The oblique sides may have a length of up to 40 mm, such as 25 mm, or may be smaller and in some cases even absent.

In an exemplary embodiment of the present adaptable mattress at a top side cassettes may be provided at a first longitudinal distance, and wherein at a bottom side cassettes may be provided at a second longitudinal distance, wherein the first distance may be 2-5 times larger than the second distance.

In an exemplary embodiment of the present adaptable mattress each cassette (2*a*,3*a*,5*a*,6*a*) individually comprises a second polymeric foam which may be different from each other cassette.

In an exemplary embodiment of the present adaptable mattress the cover and topper form one part, preferably wherein the topper is removably attached to the cover, such as by a zipper, and preferably wherein the cover comprises a zipper.

In an exemplary embodiment of the present adaptable mattress the first, second, third and further polymeric material is each independently selected from foams with a densities (DIN EN ISO 845) of 10-40 kg/m3, preferably 20-35 kg/m3, a compression load under deflection (DIN EN ISO 3386-1) of 3-7 kPa, preferably 3.5-6 kPa, such as 4.0-5.5 kPa, a tensile strength (DIN EN ISO 1798) of >80 kPa, preferably >100 kPa, such as 120-220 kPa, an elongation at break (DIN EN ISO 1798) of >100%, preferably >120%, such as 150-230%, and combinations thereof. In an exemplary embodiment of the present adaptable mattress the first polymeric foam may be an open-cellular foam.

In an exemplary embodiment of the present adaptable mattress the foams may be viscoelastic.

In an exemplary embodiment of the present adaptable mattress the cover may be elastic.

In an exemplary embodiment of the present adaptable mattress the cover may comprise fluid absorbing material.

In an exemplary embodiment of the present adaptable mattress the cover may comprise fluid releasing material.

In an exemplary embodiment of the present adaptable mattress the main part has a width of 70-200 cm.

In an exemplary embodiment of the present adaptable mattress the main part has a length of 150-250 cm.

In an exemplary embodiment of the present adaptable mattress the main part has a height of 10-40 cm.

In an exemplary embodiment of the present adaptable mattress the cover has a height of 1-10 cm.

In an exemplary embodiment of the present adaptable mattress the cassette each individually has a height of 5-20 cm.

In an exemplary embodiment of the present adaptable mattress the cassette each individually has a width of 15-50 cm.

In an exemplary embodiment of the present adaptable mattress each oblique side each individually extends over a length of 2-10 cm and/or over a height of 2-10 cm.

In an exemplary embodiment of the present adaptable mattress each protrusion individually has a height of 2-8 cm and/or a width of 2-8 cm.

In an exemplary embodiment of the present adaptable mattress each cavity individually has a height of 2-8 cm.

In an exemplary embodiment of the present adaptable mattress each incision individually has a height of 2-15 cm.

In an exemplary embodiment of the present adaptable mattress incisions may be only provided at a top side of the main part.

In an exemplary embodiment of the present adaptable mattress incisions may be provided in between recesses.

In an exemplary embodiment of the present adaptable mattress the mattress, or at least one part thereof, may be reusable.

In an exemplary embodiment of the present adaptable mattress the mattress, or at least one part thereof, may be a foam mattress.

In an exemplary embodiment of the present adaptable mattress cassette 3*a* may located substantially in the middle of the mattress, and preferably exactly in the middle.

In an exemplary embodiment of the present adaptable mattress further air circulation elements 9 may be provided underneath at least one of cassettes 2*a*.

In an exemplary embodiment of the present adaptable mattress an incision may be provided for supporting release of a cassette, which incision may be in the form of an < or >.

In an exemplary embodiment the present method may comprise selecting at least one cassette (2*a*,3*a*,5*a*,6*a*) adapted to a second user, preferably cassettes (2*a*,3*a*) or cassettes (5*a*,6*a*).

In an exemplary embodiment the present method may comprise replacing at least one of a cassette (2*a*,3*a*,5*a*,6*a*) with a new cassette (2*a*,3*a*,5*a*,6*a*), a topper (7) with a new topper (7), and a cover (8) with a new cover (8).

In an exemplary embodiment the present method may comprise recirculating at least one of the main part, the at least one cassette, the topper, and the cover.

In an exemplary embodiment the present method may comprise compressing the mattress to 15-25% of its uncompressed size, and transporting the mattress to the user.

The invention is further detailed by the accompanying figures and examples, which are exemplary and explanatory of nature and are not limiting the scope of the invention. To the person skilled in the art it may be clear that many variants, being obvious or not, may be conceivable falling within the scope of protection, defined by the present claims.

BRIEF DESCRIPTION OF THE FIGURES

FIGS. 1-8*c* show various details of the present adaptable mattress.

DETAILED DESCRIPTION OF THE FIGURES

FIGS. 1*a-d*, 2*a-c*,3*a-c*, 4*a-c*, 5*a-c*, 6*a-c*, 7*a-c* and 8*a-c* show various details of the present adaptable mattress.

Figure 1A:
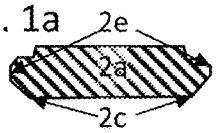
Figure 1B:
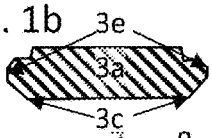
Figure 1C:
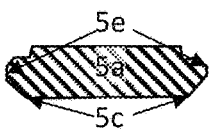
Figure 1D:
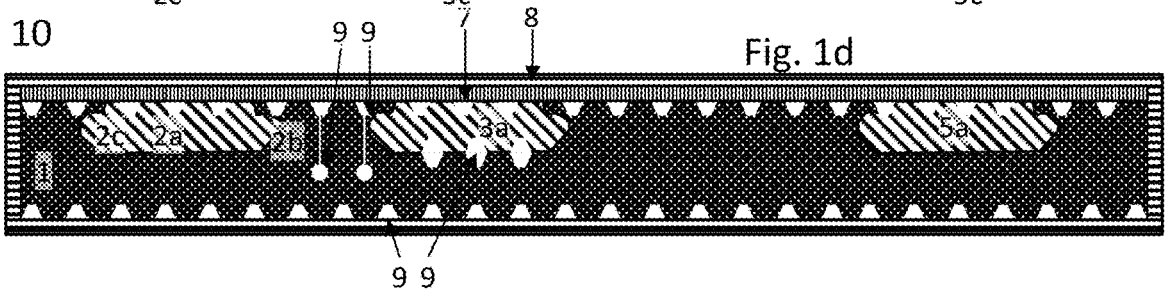
Figure 2A:
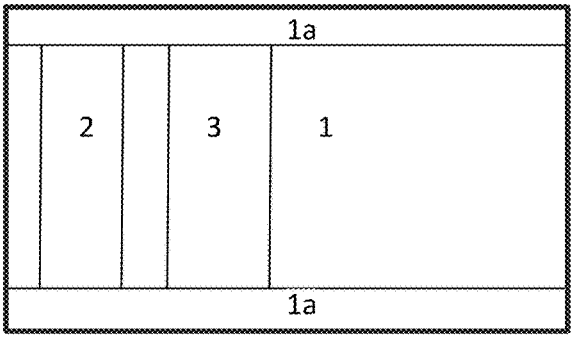
Figure 3A:
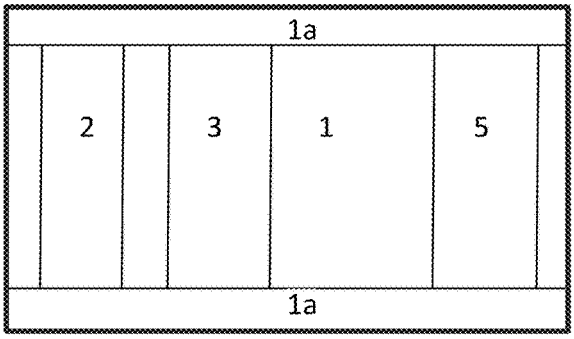
Figure 2B:
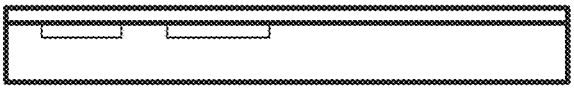
Figure 3B:
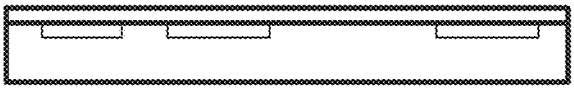
Figure 2C:
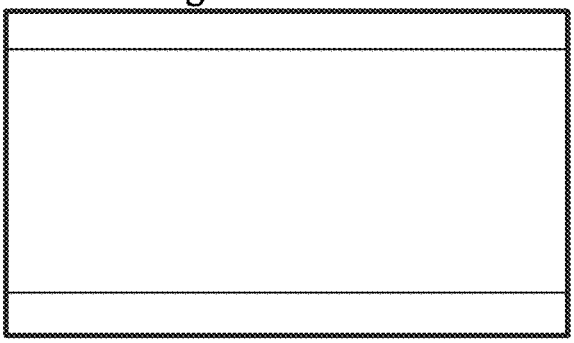
Figure 3C:
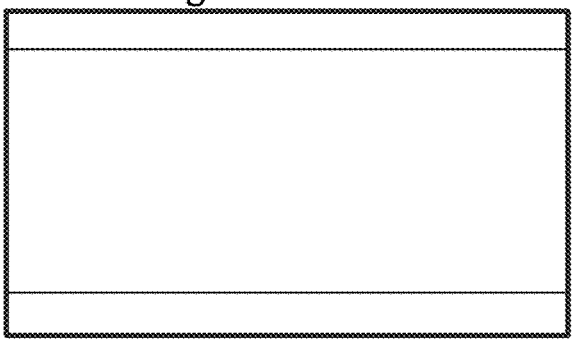
Figure 4A:
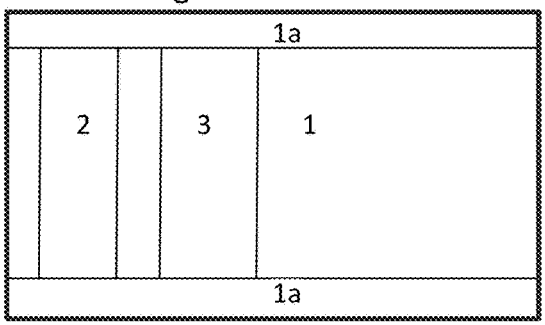
Figure 4B:
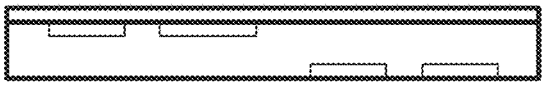
Figure 4C:
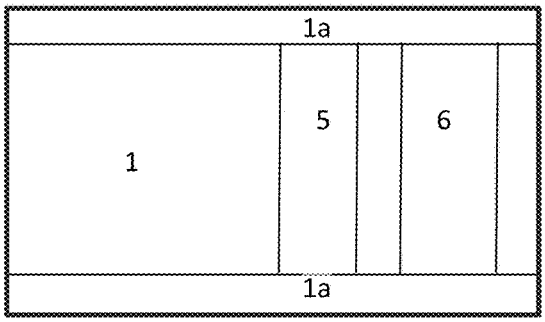
Figure 5A:
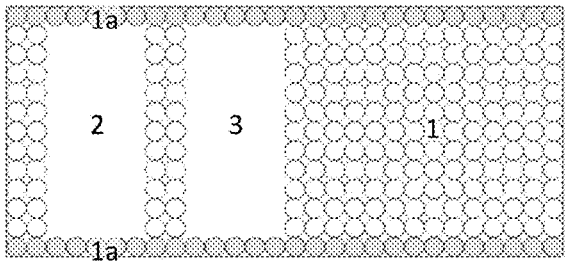
Figure 5B:
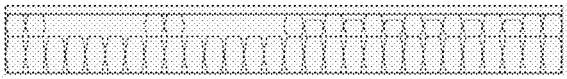
Figure 5C:
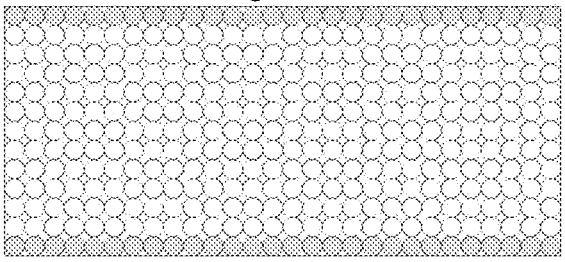
Figure 6A:
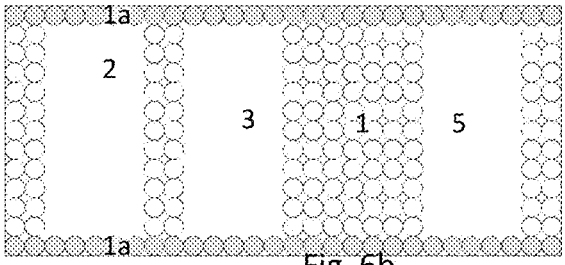
Figure 6B:
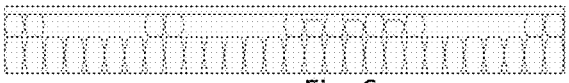
Figure 6C:
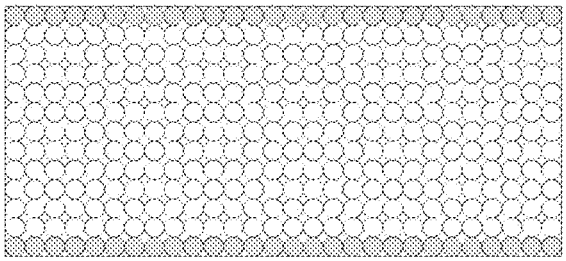
Figure 7A:
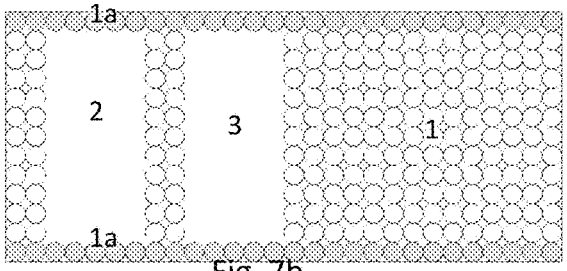
Figure 7B:
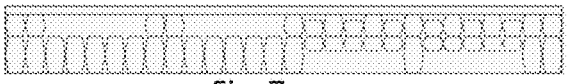
Figure 7C:
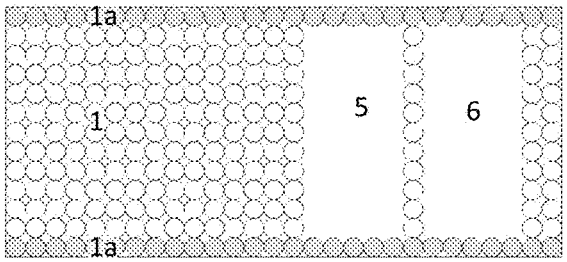

In the figures:

10 adaptable mattress
1 main part
1*a* main part edge
2 recess
2*a* cassette
2*b* oblique lower side recess
2*c* oblique lower side cassette
2*d* oblique upper side recess
2*e* oblique upper side cassette
3 recess
3*a* cassette
3*b* oblique lower side recess
3*c* oblique lower side cassette
3*d* oblique upper side recess
3*e* oblique upper side cassette
5 recess
5*a* cassette
5*b* oblique lower side recess
5*c* oblique lower side cassette
5*d* oblique upper side recess
5*e* oblique upper side cassette
6 recess
6*a* cassette
7 topper
8 cover
9 air circulation supporting element In FIGS. 1*a-c* three cassettes are shown which are found in FIG. 1*d*. FIGS. 2-7 show top views (FIGS. 2*a*-7*a*), cross-sectional views (FIGS. 2*b*-7*b*) and bottom views (FIGS. 2*c*-7*c*) of foam mattresses (FIGS. 2-4) and pocket springs mattresses (FIGS. 5-7).

FIGS. 8*a-c* show a recent variant wherein three cassettes 2*a*,3*a*,2*a* are provided at a top side. Cassettes 2*a* may be different from cassette 3*a*. Cassette 3*a* is located substantially in the middle of the mattress, and preferably exactly in the middle. In addition further air circulation elements 9 may be provided underneath at least one of cassettes 2*a*. Also an incision may be provided for supporting release of a cassette, which incision may be in the form of an < or >.

The figures are further detailed throughout the description and claims.

It should be appreciated that for commercial application it may be preferable to use one or more variations of the present system, which would similar be to the ones disclosed in the present application.

The invention claimed is:

1. An adaptable mattress, comprising a mattress main part, the mattress main part comprising at least two recesses, each recess of the at least two recesses extending substantially over a width of the mattress main part, each recess being provided on a side selected from a top and bottom side of the mattress main part, at least two removable cassettes for filling the at least two recesses, each cassette of the at least two cassettes having a height, a width, and a length, wherein the length of each cassette is substantially equal to a width of the mattress main part, wherein the at least two recesses are adapted to fix each respective cassette, and wherein each cassette is less resilient than the mattress main part, wherein a first cassette of the at least two cassettes located at a first shoulder section of the mattress comprises more air circulation supporting elements than a second cassette of the at least two cassettes located at a first hip section of the mattress, and wherein an third cassette of the at least two cassettes located at a shoulder section of the mattress comprises more air circulation supporting elements than the second cassette and less air circulation supporting elements than a fourth cassette of the at least two cassettes located at a second hip section of the mattress, a topper applied on the top side of the mattress main part, the topper comprising a third material, wherein the third material has a different resilience than that of both the mattress main part and the at least two cassettes, and a cover, the cover surrounding the mattress main part, the cassettes, and the topper, wherein the mattress main part, the cassettes, the topper, and the cover are removably attached to one another, wherein the mattress main part comprises an edge at each side of each recess for preventing movement of the cassette in the recess and wherein no adhesive is present, wherein 5-50 air circulation supporting elements are provided on a top side of the mattress main part, and wherein 5-50 air circulation supporting elements are provided on the bottom side of the mattress main part, and wherein 1-10 air circulation supporting elements are provided in a central section of the mattress main part, and wherein 1-10 air circulation supporting elements are each individually provided on a top side of the cassette, and wherein 1-10 air circulation supporting elements are each individually provided on a bottom side of the cassette, and wherein 1-10 air circulation supporting elements are each individually provided on a bottom side of each recess, and wherein the air circulation supporting elements of each recess and each cassette are provided facing one and another, and wherein the air circulation supporting elements of each recess and each cassette are provided alternating.

2. An adaptable mattress, comprising a mattress main part, the mattress main part comprising at least two recesses, each recess of the at least two recesses extending substantially over a width of the mattress main part, each recess being provided on a side selected from a top and bottom side of the mattress main part, at least two removable cassettes for filling the at least two recesses, each cassette of the at least two cassettes having a height, a width, and a length, wherein the length of each cassette is substantially equal to a width of the mattress main part, wherein the at least two recesses are adapted to fix each respective cassette, and wherein each cassette is less resilient than the mattress main part, wherein a first cassette of the at least two cassettes located at a first shoulder section of the mattress comprises more air circulation supporting elements than a second cassette of the at least two cassettes located at a first hip section of the mattress, and wherein an third cassette of the at least two cassettes located at a shoulder section of the mattress comprises more air circulation supporting elements than the second cassette and less air circulation supporting elements than a fourth cassette of the at least two cassettes located at a second hip section of the mattress, a topper applied on the top side of the mattress main part, the topper comprising a third material, wherein the third material has a different resilience than that of both the mattress main part and the at least two cassettes, and a cover, the cover surrounding the mattress main part, the cassettes, and the topper, wherein the mattress main part, the cassettes, the topper, and the cover are removably attached to one another, wherein the mattress main part comprises an edge at each side of each recess for preventing movement of the cassette in the recess and wherein no adhesive is present, wherein the mattress main part comprises springs, and wherein at least one of the at least two cassettes comprises springs, and wherein the mattress main part comprises a first polymeric foam, and wherein each cassette individually comprises a second polymeric foam, which second polymeric foam is less resilient than said first polymeric foam, and wherein the first the second, a third and a further polymeric foam is each independently selected from foams with densities (DIN EN ISO 845) of 10-40 kg/m3, a compression load under deflection (DIN EN ISO 3386-1) of 3-7 kPa, a tensile strength (DIN EN ISO 1798) of >80 kPa, an elongation at break (DIN EN ISO 1798) of >100%, and combinations thereof, and wherein the first polymeric foam is an open-cellular foam, and wherein the foams are viscoelastic, and wherein the cover is elastic, and wherein the cover comprises fluid absorbing material, and wherein the cover comprises fluid releasing material, and wherein the mattress main part has a width of 70-200 cm, and wherein the mattress main part has a length of 150-250 cm, and wherein the mattress main part has a height of 10-40 cm, and wherein the cover has a height of 1-10 cm, and wherein each cassette each individually has a height of 5-20 cm, and wherein each cassette each individually has a width of 15-50 cm, and wherein each oblique side each individually extends over a length of 2-10 cm and over a height of 2-10 cm, and wherein the air circulation supporting elements are selected from a protrusion, a cavity, and an incision, and wherein each protrusion individually has a height of 2-8 cm and a width of 2-8 cm, and wherein each cavity individually has a height of 2-8 cm, and wherein each incision individually has a height of 2-15 cm, and wherein the incision is only provided at the top side of the mattress main part, or in between the at least two recesses, and wherein at least one part of the mattress is reusable, and wherein at least one part of the mattress is a foam mattress.

* * * * *